US007219613B2

(12) United States Patent
Root, Jr.

(10) Patent No.: US 7,219,613 B2
(45) Date of Patent: May 22, 2007

(54) RECONFIGURABLE ATTACK AND RECONNAISSANCE VESSEL II

(75) Inventor: George Raymond Root, Jr., Gambrills, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/118,262

(22) Filed: Apr. 29, 2005

(65) Prior Publication Data

US 2006/0075948 A1 Apr. 13, 2006

Related U.S. Application Data

(60) Provisional application No. 60/567,271, filed on Apr. 30, 2004.

(51) Int. Cl.
*B63B 1/00* (2006.01)

(52) U.S. Cl. ..... 114/61.15; 114/77 R

(58) Field of Classification Search ..... 114/77 A, 114/77 R, 61.1–61.22, 344, 1, 239, 261, 5, 114/4, 258–260, 292; 440/12.5–12.61; 89/1.802, 89/1.11, 37.01

See application file for complete search history.

(56) References Cited

U.S. PATENT DOCUMENTS

| | | | | |
|---|---|---|---|---|
| 1,334,445 | A * | 3/1920 | Gaffney | 114/261 |
| 1,920,507 | A * | 8/1933 | Holloway | 244/140 |
| 2,227,725 | A * | 1/1941 | Laddon | 280/47.131 |
| 2,405,115 | A * | 8/1946 | Creed | 114/261 |
| 3,541,987 | A * | 11/1970 | Barkley | 114/61.16 |
| 4,085,695 | A * | 4/1978 | Bylo | 114/260 |
| 4,474,128 | A | 10/1984 | Wallach | |
| 4,553,493 | A * | 11/1985 | Sadler et al. | 114/1 |
| 4,697,764 | A * | 10/1987 | Hardy et al. | 244/137.4 |
| 5,176,098 | A * | 1/1993 | Royle | 114/344 |
| 5,237,947 | A | 8/1993 | Manning | |
| 5,544,607 | A | 8/1996 | Rorabaugh et al. | |
| 5,915,321 | A * | 6/1999 | Fountaine | 114/61.15 |
| 5,924,377 | A * | 7/1999 | Rausch et al. | 114/77 R |
| 6,089,173 | A | 7/2000 | Lande | |
| 6,159,058 | A * | 12/2000 | Matheson | 440/12.5 |
| 2004/0149194 | A1 * | 8/2004 | Schmidt et al. | 114/60 |

FOREIGN PATENT DOCUMENTS

| | | | |
|---|---|---|---|
| DE | 3326942 | A1 | 2/1984 |
| DE | 3614291 | A1 | 10/1987 |
| WO | 03/033336 | A1 | 4/2003 |

OTHER PUBLICATIONS http://www.bismarck-class.dk/hilfskreuzer/hilfskreuzer_introduction.html□□Hifskreuzer, WWII history of German commerce raiders.*

* cited by examiner

*Primary Examiner*—Ed Swinehart
(74) *Attorney, Agent, or Firm*—DeMont & Breyer, LLC

(57) ABSTRACT

A reconfigurable marine vessel is disclosed. The marine vessel includes an upper hull, two propulsion hulls, and two struts for coupling the propulsion hulls to the upper hull. The struts are segmented and are capable of reconfiguring the marine vessel. The upper hull includes a mission module for carrying mission specific payloads. A mission bay is disposed in at least one of the propulsion hulls. The mission bay is used to carry fuel, swimmer gear, weapons, etc. Each propulsion hull also includes wheel assembies.

9 Claims, 11 Drawing Sheets

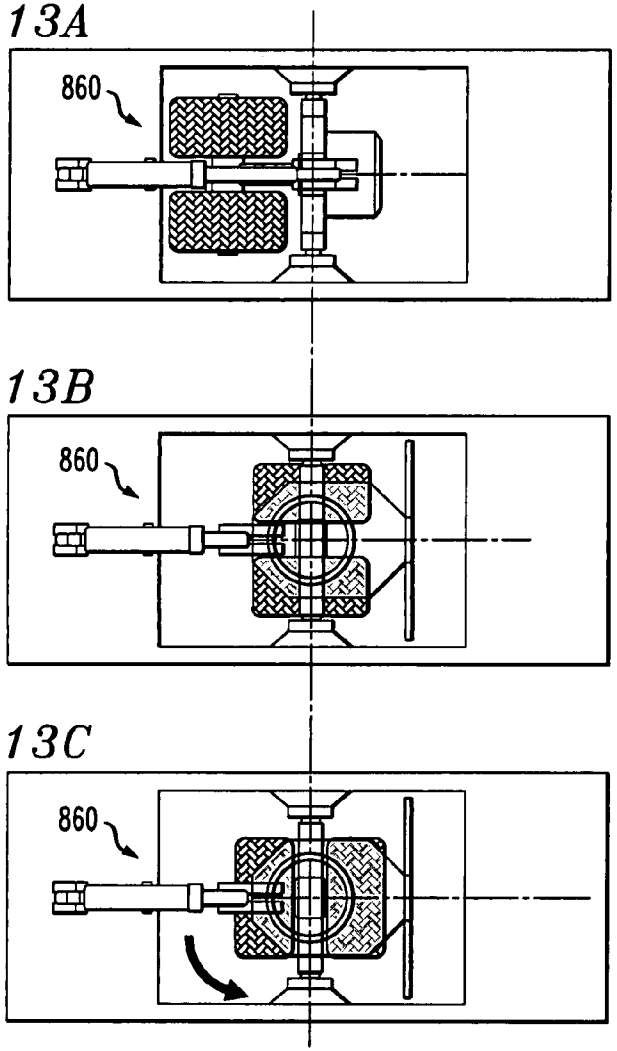
FIG. 13A
FIG. 13B
FIG. 13C
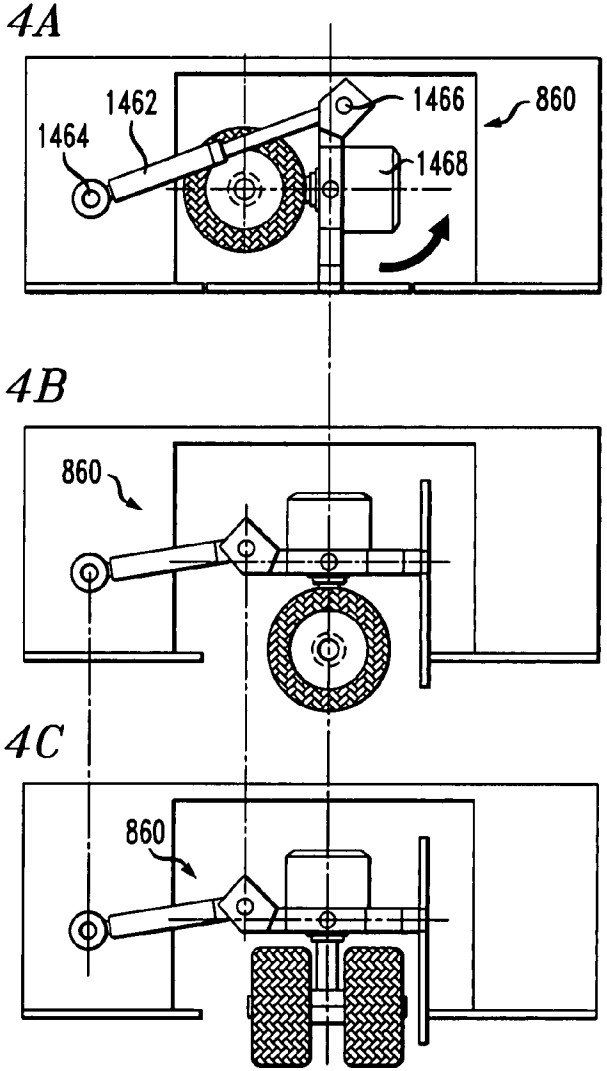
FIG. 14A
FIG. 14B
FIG. 14C

RECONFIGURABLE ATTACK AND RECONNAISSANCE VESSEL II

STATEMENT OF RELATED CASES

This case claims priority of U.S. provisional patent application 60/567,271, which was filed on Apr. 30, 2004 and is incorporated by reference herein.

FIELD OF THE INVENTION

The present invention relates generally to high-speed attack and reconnaissance vessels.

BACKGROUND OF THE INVENTION

When maneuvering in restricted conditions, moored, or at anchor, Navy vessels are particularly vulnerable to attack from a group of small, fast boats. Due to their size, speed, and maneuverability, these small boats can attack and then run and hide from larger navy vessels. To make matters worse, the hostiles will often be operating in their own waters where they will typically enjoy a significant numerical advantage and superior knowledge of the waterways. This type of attack, which is referred to as a "small-boat-swarm," is the tactic of choice for terrorists.

Small-boat-swarm is best countered by similarly-sized, stealthy, fast, heavily-armed craft. An appropriately outfitted Zodiac-type raft has been used for this service. But even highly-trained navy personnel have a limited capability to withstand the repeated shock to their bodies that occurs when traveling in such craft at high speed in moderately high sea states.

Another type of craft that could be used for this type of engagement is an attack helicopter. The primary attributes of the attack helicopter include its tactical agility (e.g., speed, horizon masking, and engagement geometry), assortment of weaponry, and its ability to engage multiple targets. Its primary limitations are its signatures (e.g., radar, infrared, visual and audible) and a sortie time that is limited to only about two hours.

There is a need, therefore, for a vessel that is fast, maneuverable, and suitably equipped to engage and counter a small-boat-swarm or reconnoiter undetected in littoral waters.

SUMMARY

The present invention provides a relatively small, stable, low-signature, fast, heavily-armed marine vessel that can sortie from a larger ship and conduct surface warfare functions in shallow littoral environments.

A marine vessel in accordance with the illustrative embodiment of the present invention includes an upper hull, two lower hulls that contain propulsion units, and articulating struts that couple the lower hulls to the upper hull. The articulating struts enable the marine vessel to reconfigure, even while its underway.

In addition to its ability to reconfigure, the marine vessel incorporates other features that, like its ability to reconfigure, are unique among naval vessels and provide it with a significant tactical advantage in military engagements.

One of these features is a removable mission module. The mission module is intended to carry mission-specific payloads. Such payloads are not used for most missions and, as such, are not part of the core systems of the marine vessel. Examples of mission-specific payloads include, without limitation, certain types of weapons, specialized sensors, expendables, and even personnel.

The mission module resides in a mission-module bay, which is disposed toward the aft end of the upper hull. The mission module is inserted into and removed from the bay through an opening at the stern of marine vessel. This process can be performed, for example, while the marine vessel is aboard a mother ship (using a crane, etc.).

The use of the mission module enables a single marine vessel to conduct many different types of missions. In other words, there is no need to provide multiple marine vessels, each outfitted differently, to support different missions.

In the illustrative embodiment, when the mission module is disposed in the mission-module bay, the exterior of the mission module forms a portion of the upper hull of the marine vessel. The mission module is configured with standard mechanical, electrical, and data interfaces that couple to appropriate interfaces within the upper hull.

Marine vessel 100 includes four additional mission bays. Two such bays are disposed near the bow of each of the lower hulls. These lower mission bays can be used to transport various mission payloads, such as extra fuel, underwater sensors, swimmer equipment, sonobuoys, and underwater weapons such as torpedos or mine countermeasures.

Another useful feature of a marine vessel in accordance with the illustrative embodiment of the invention is the inclusion of four sets of wheels, two of which sets are housed in each of the lower hulls. The wheels enable the marine vessel to move about the operations decks of its mother ship without additional handling equipment. When the marine vessel is in its launch/recovery configuration, the wheels deploy from the lower hulls. When the articulated struts are unfolded for operation, the wheels retract. The wheels are driven, so that the vessel can move under its own power.

On board the mother ship, it is normally necessary to move small vessels laterally to clear the vessel-recovery area. But there is often little room to maneuver. In accordance with the illustrative embodiment, the wheels of the marine vessel are capable of rotating 90 degrees so that the vessel can move laterally rather than having to "turn."

BRIEF DESCRIPTION OF THE DRAWINGS

FIG. 2A depicts marine vessel 100 in its "cruise-and-surveillance" configuration and without a mission module in the mission-module bay.

FIGS. 13A through 13C depict a top view of the wheels in either a retracted mode or in extended modes.

FIGS. 14A through 14C depicts a side view of the wheels in either a retracted mode or in extended modes.

DETAILED DESCRIPTION

The illustrative embodiment of the present invention provides a reconfigurable marine vessel. In the illustrative embodiment, the marine vessel is manned. There are, however, alternative embodiments in which the marine vessel is unmanned. The unmanned vessel, which is not depicted herein, has substantially the same form as the manned vessel and includes, with the exception of a manned cockpit, the same features as the manned vessel. The unmanned vessel, which can be smaller than the manned version, is typically operated by a remote, airborne operator (in a helicopter, etc.).

The Ability to Reconfigure

A key feature of the illustrative marine vessel is its ability to reconfigure. This feature is described in detail in U.S. patent application Ser. No. 11/119,187 entitled "Reconfigurable Attack and Reconnaissance Vessel I," which is incorporated by reference herein. To provide context for the features of the marine vessel that are disclosed herein, a brief summary of its ability to reconfigure is provided below.

Figure 1B:
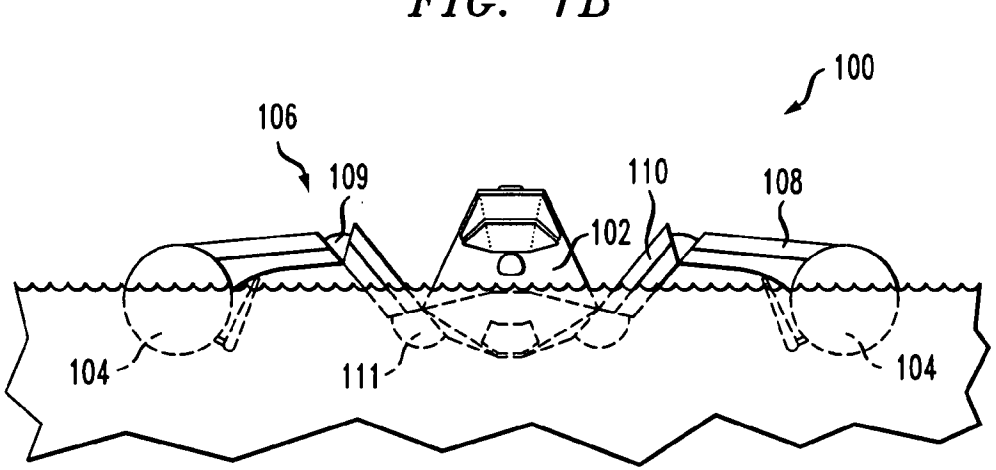
FIGS. 1A through 1C depicts reconfigurable marine vessel 100 in its three primary configurations: cruise-and-surveillance (FIG. 1A); minimum draft (FIG. 1B); and launch-and-recovery (FIG. 1C).
Figure 1A:
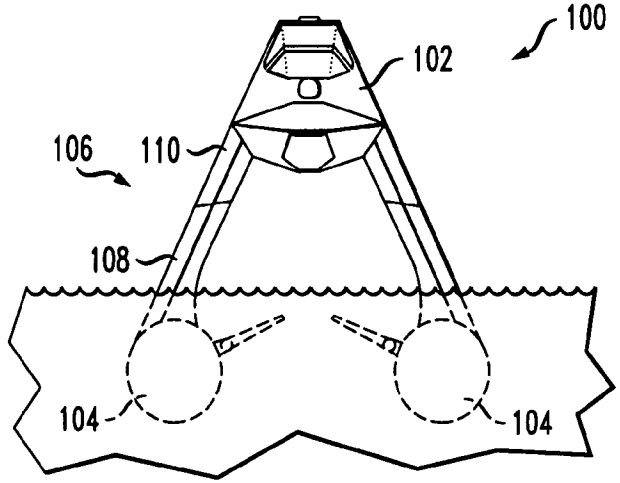
Figure 1C:
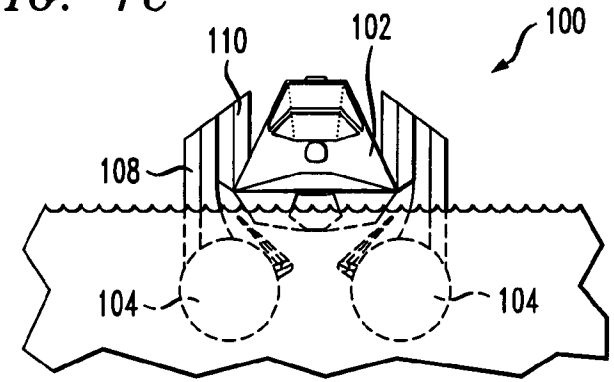

A marine vessel in accordance with the illustrative embodiment of the invention is capable of reconfiguring into any of three primary configurations, as depicted in FIGS. 1A through 1C. The three primary configurations are: a cruise-and-surveillance configuration (FIG. 1A), a minimum-draft configuration (FIG. 1B), and a launch-and-recovery configuration (FIG. 1C).

As depicted in the bow-end views of FIGS. 1A through 1C, marine vessel 100 includes upper hull 102, lower hulls 104, and struts 106. The struts are segmented into lower segment 108 and upper segment 110 by joints or hinges. Hinge 109 movably couples lower segment 108 to upper segment 110 and hinge 111 movably couples upper segment 110 to upper hull 102.

The three primary configurations of marine vessel 100 are obtained by changing the position of the segments with respect to one another, with respect to upper hull 102, or both. It is to be understood that, within their range of motion, the segments of strut 106 are substantially infinitely positionable so that are variety of other configurations are possible as well.

FIG. 1A depicts vessel 100 in a cruise-and-surveillance configuration. In this configuration, lower strut 108 and upper strut 110 are co-linear and are fully extended below and slightly outward of upper hull 102. Of the three primary configurations, the cruise-and-surveillance configuration provides the maximum distance between the lower hulls and the upper hull. This distance is sufficient to enable operation in significant sea states and enables marine vessel 100 to be operated as a SWATH.

FIG. 1B depicts marine vessel 100 in the minimum-draft configuration. In this configuration, lower strut 108 and upper strut 110 extend substantially laterally from upper hull 102 and the bottom surface of lower hulls 104 and bottom surface of upper hull 102 are substantially co-planar. A substantial portion of lower hulls 104 are above the water line and a substantial portion of upper hull 102 is below the water line. This configuration, which has a draft of only about 0.9 meters, enables marine vessel 100 to approach a beach, etc., to deploy or extract personnel, among other activities.

FIG. 1C depicts marine vessel 100 in the launch-and-recovery configuration. In this configuration, lower strut 108 and upper strut 110 are folded so that they are substantially parallel to one another. In the launch-and-recovery configuration, the manned version of marine vessel 100 has a width of about 3.7 meters and a height of about 3.7 meters, which is about ⅔ the height and ⅔ the width of marine vessel 100 as when the struts are fully extended. In this configuration, marine vessel 100 occupies its minimum storage volume, which is less than about 50 percent of the storage volume as when the struts are fully extended. This enables the vessel to reduce its size sufficiently to be launched, recovered and housed aboard a mother ship.

Some additional important features of marine vessel 100 are now described in detail.

Mission Module—Upper Hull

Figure 2A:
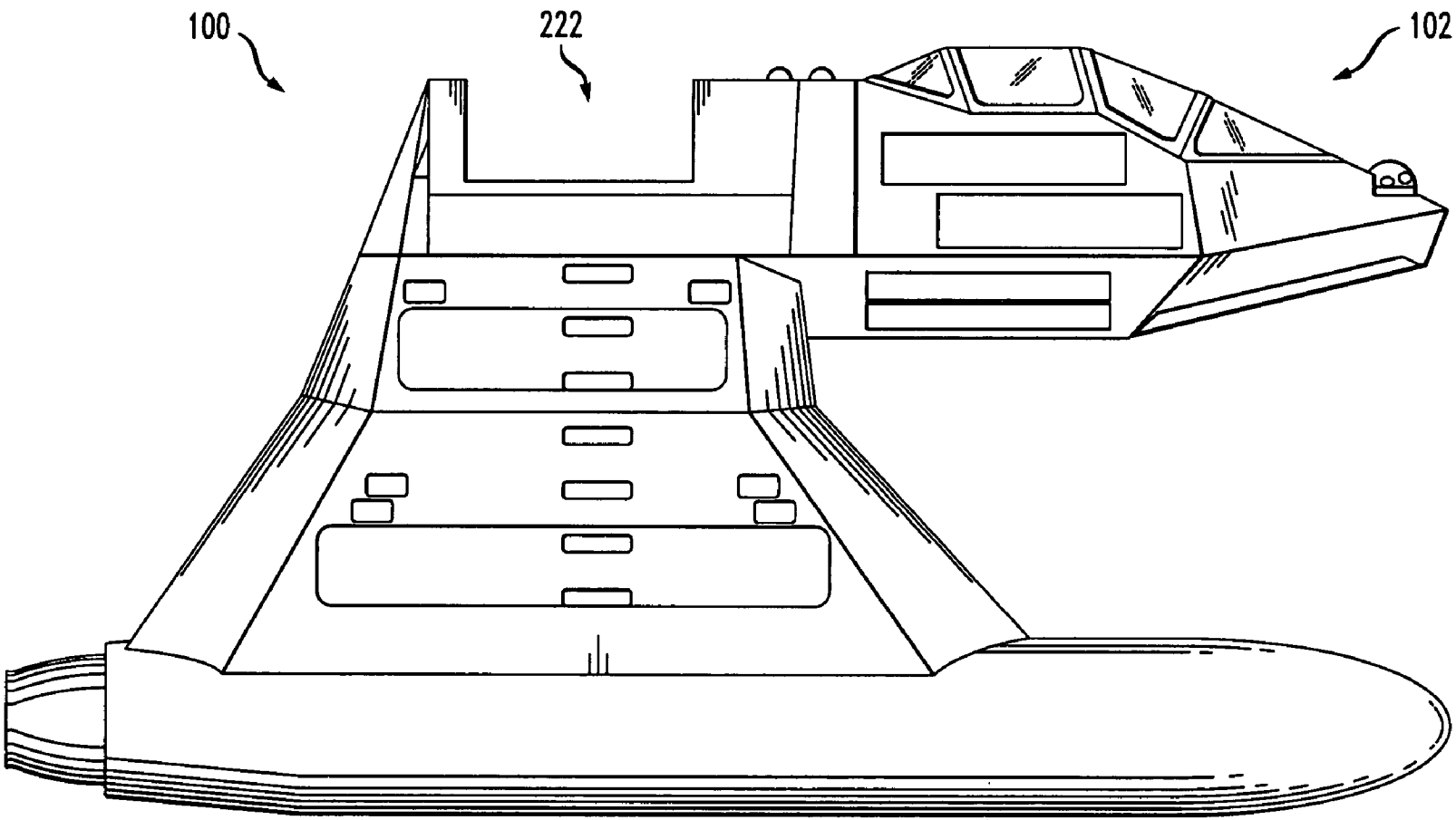
FIG. 2A depicts a side view of reconfigurable marine vessel 100 in accordance with the illustrative embodiment of the present invention.
Figure 2B:
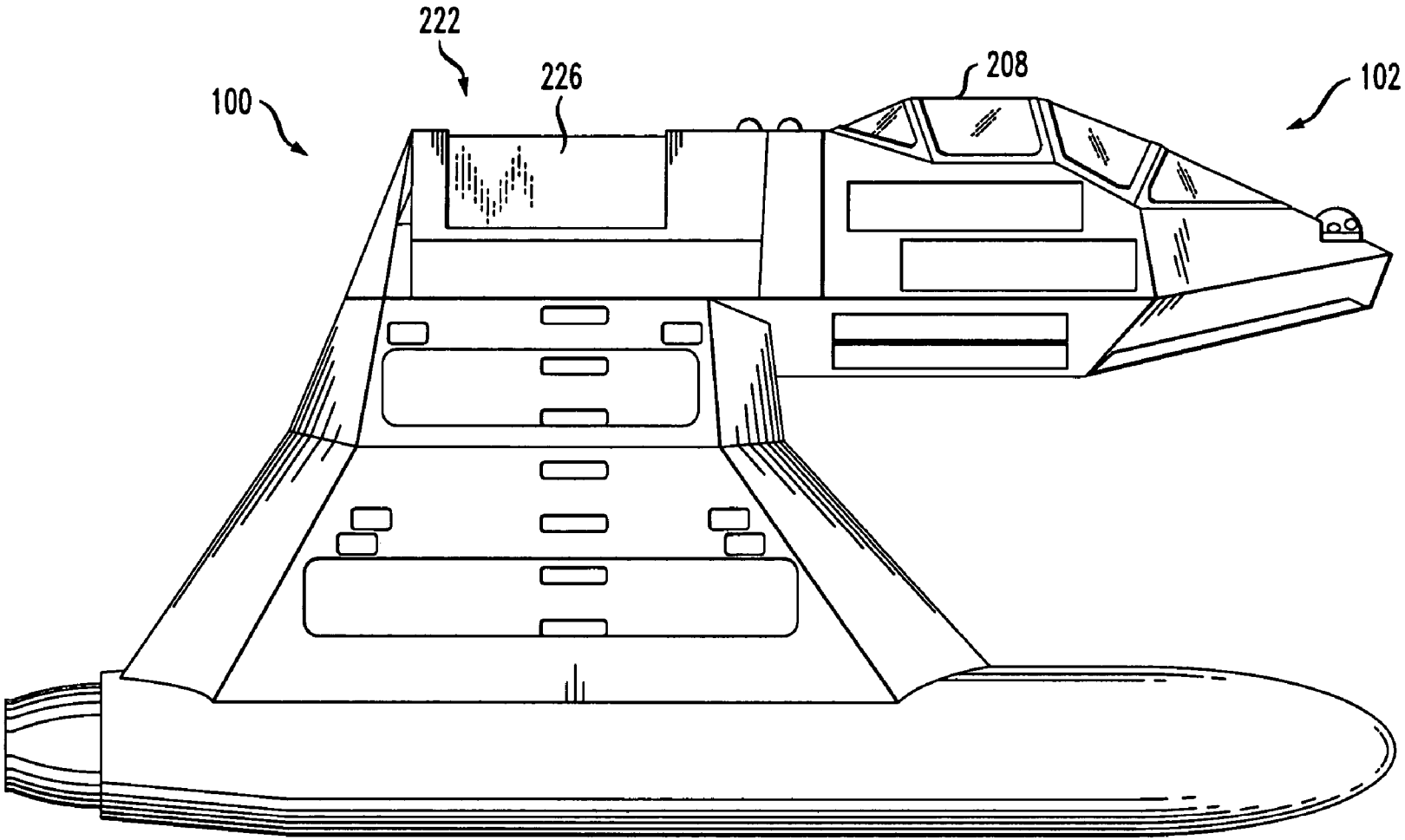
FIG. 2B depicts a side-view of the marine vessel of FIG. 2A, but with a mission module in the mission-module bay.
Figure 3B:
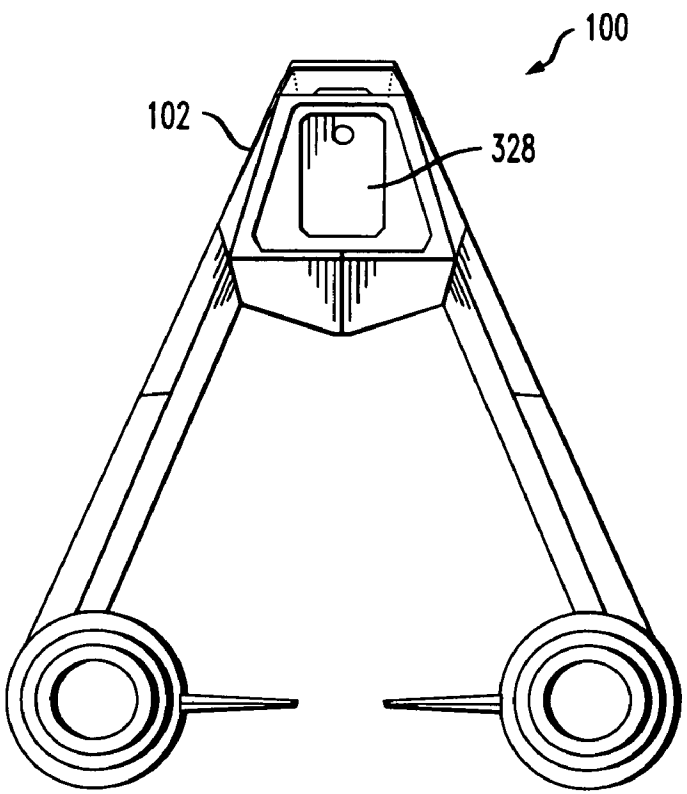
FIG. 3B depicts a stern-end view of the marine vessel of FIG. 2A, but with a mission module in the mission-module bay.
Figure 3A:
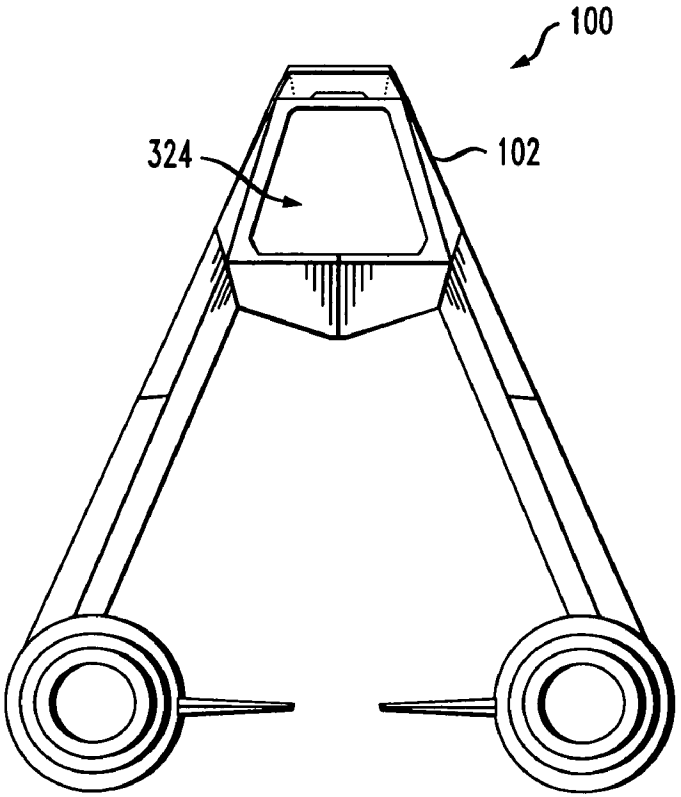
FIG. 3A depicts a stern-end view of the marine vessel of FIG. 2A.
Figure 4:
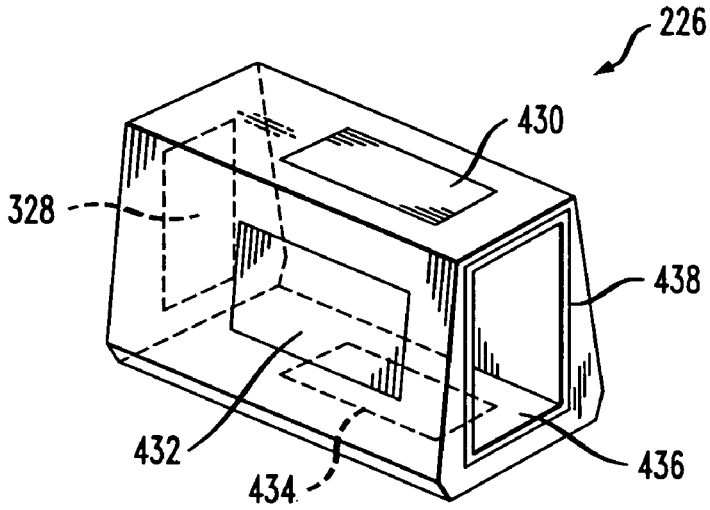
FIG. 4 depicts a perspective view of a mission module for use with the illustrative embodiment of the present invention.

FIGS. 2A and 2B depict side views and FIGS. 3A and 3B depicts stern-end views of marine vessel 100 in accordance with the illustrative embodiment of the present invention. FIGS. 2A and 3A depict marine vessel 100 sans mission module 226. That is, the mission module is not in mission-module bay 222. FIGS. 2B and 3B depicts marine vessel 100 with mission module 226 in the mission-module bay. FIG. 4 depicts an embodiment of mission module 226.

The mission module is intended to carry mission-specific payloads. Such payloads are not used for most missions and, as such, are not part of the core systems of the marine vessel. Examples of mission-specific payloads include, without limitation, certain types of weapons, specialized sensors, expendables, and even personnel.

As depicted in FIGS. 2A and 2B, mission-module bay 222 is disposed toward the aft end of upper hull 102. In the illustrative embodiment, when mission module 226 is disposed in mission-module bay 222, the exterior of the mission module serves as a portion of upper hull 102 of marine vessel 100.

Mission module 226 is configured with standard mechanical, electrical, and data interfaces (not depicted), which couple to appropriate interfaces within upper hull 102. In the illustrative embodiment that is depicted in FIG. 4, mission module 226 includes rear hatch 328, top hatch(es) 430, side hatch(es) 432, bottom hatch 434, and front hatch 436.

Rear hatch 328 provides access to the interior of mission module 226 from the exterior of the marine vessel 100. Top hatch 430 and side hatch 432 are used to deploy sensors, weapons, etc. from mission module 326. Bottom hatch 434 is used to deploy systems such as towed sonar bodies and dipping sonar. To that end, bottom hatch 434 interfaces to a matching opening on the floor of mission-module bay 222.

Front hatch 436 provides access to a region (not depicted) that is behind and/or underneath cockpit 208. Seal 438, which is disposed around front hatch 436, seals mission module 226 to marine vessel 100 at this region. By virtue of this arrangement, a water-tight seal is simply and efficiently created between mission module 226 and marine vessel 100. In some embodiments, mission module 226 does not incorporate front hatch 436. Depending upon the layout of the region behind cockpit 208, seal 438 might or might not be required. That is, if there is a solid wall (e.g., bulkhead, etc.) behind the cockpit, such that the forward section of upper hull 102 is sealed off from the aft section, then seal 438 is not required. In fact, in such embodiments, marine vessel 100 can operate without mission module 226 in mission-module bay 222

In some embodiments, mission module 226 is inserted into and removed from mission-module bay 222 through opening 324 at the stern of marine vessel 100. The insertion and removal process can be performed, for example, with a crane while marine vessel 100 is aboard its mother ship.

Figure 5:
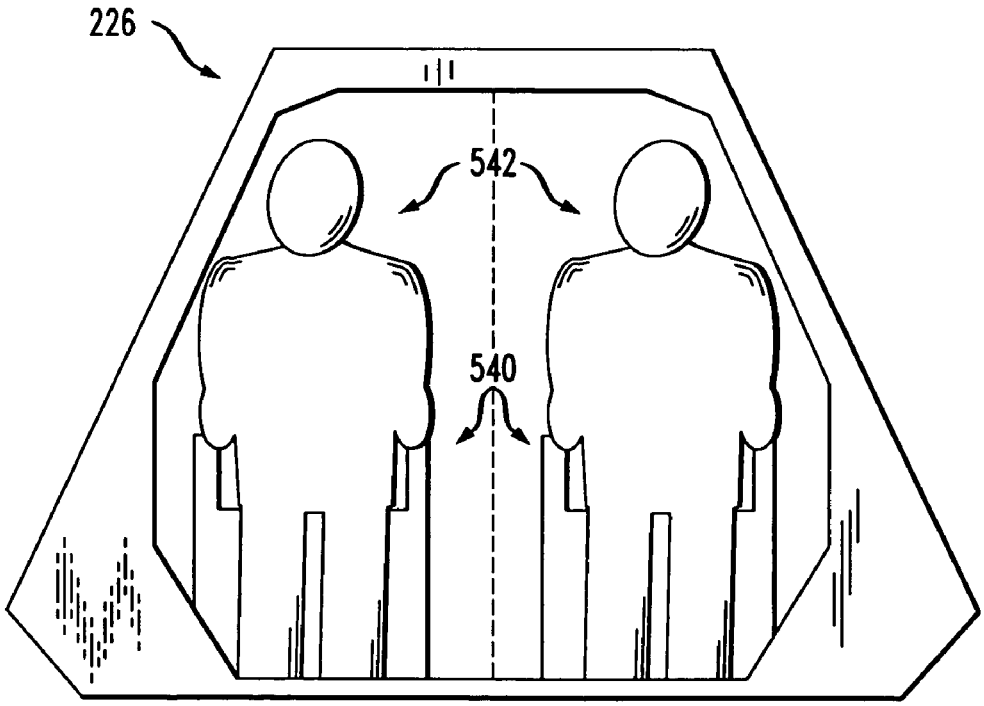
FIG. 5 depicts a sectional view of a mission module that is adapted for carrying personnel.
Figure 6:
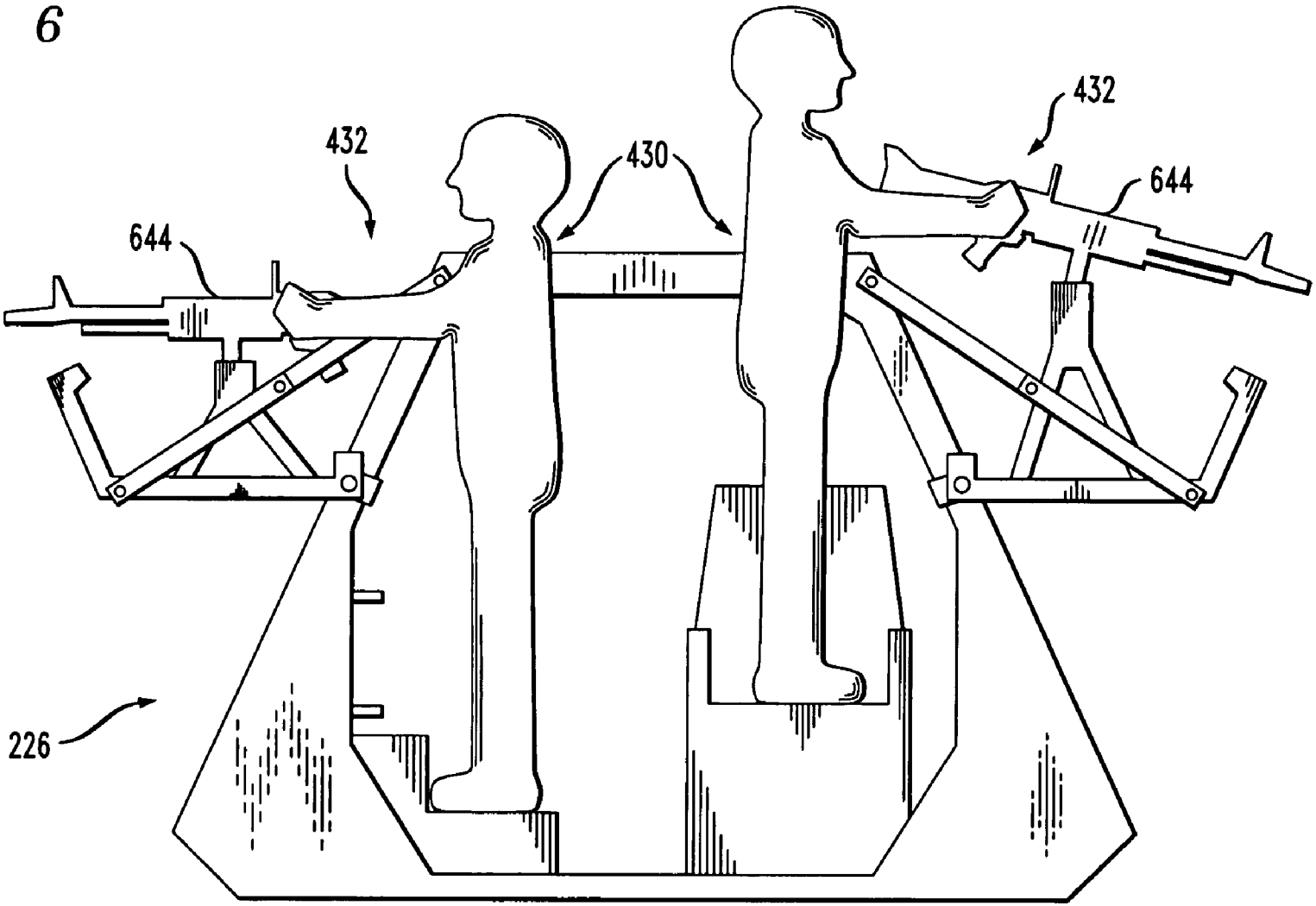
FIG. 6 depicts a sectional view of a mission module that is physically adapted to support manned weapons.
Figure 7:
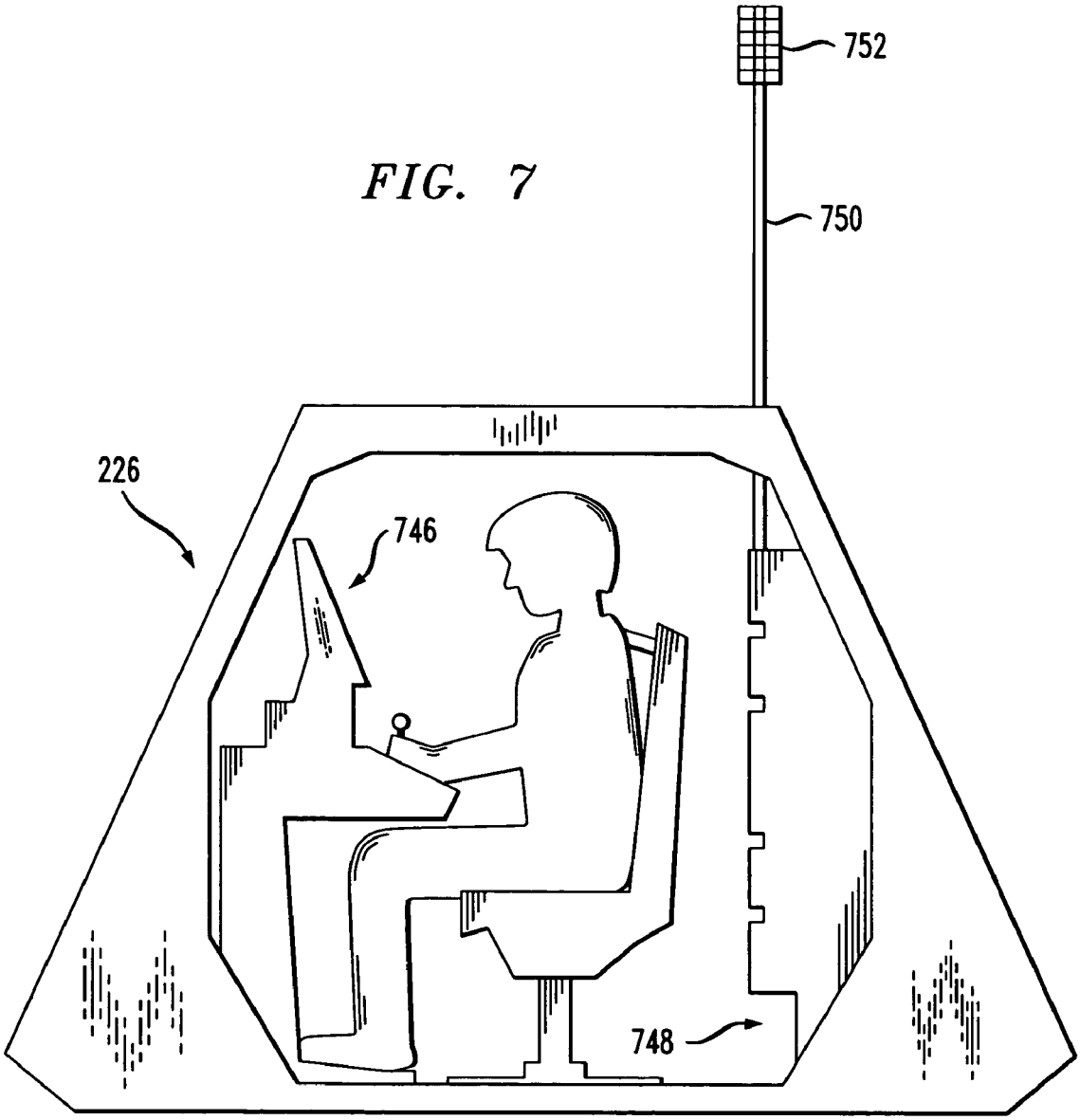
FIG. 7 depicts a sectional view of a mission module that is physically adapted to support intelligence/sensor monitoring.

FIGS. 5 through 7 depict mission module 226 outfitted for various missions. FIG. 5, which depicts an stern-end view of mission module 226, shows the mission module configured to carry personnel. As depicted in FIG. 5, mission module 226 includes seats 540 and personnel 542. Having a nominal width of about 2.1 meters and a nominal length of about 2.1 meters, mission module 226 can accommodate six seats 540, disposed in a 3×2 arrangement.

FIG. 6 depicts mission module 226 outfitted with auxiliary manned weapons 644. The weapons are deployed through side hatches 432. Personnel can man the weapons through top hatches 430 and the side hatches.

FIG. 7 depicts mission module 226 outfitted for intelligence gathering/monitoring. For this application, mission module 226 includes sensor control station 746, sensor processing electronics 748, extendable sensor mast 750, and sensors 752, which depend from the extendable mast.

FIGS. 5-7 provide a few illustrative configurations an outfitted mission module 226. That is, these Figures depict some ways in which mission module 226 can be outfitted to support specific operations. Those skilled in the art, after reading this specification, will be able to configure mission module 226 as appropriate to support any of a variety of specific operations.

Mission Bays—Lower Hulls

Referring now to FIGS. 8 through 11, marine vessel 100 includes two additional mission bays 850 in each of lower hulls 104. These mission modules are disposed at the bow of each lower hull 104. The mission bays can be used to transport various mission payloads, such as extra fuel, underwater sensors, swimmer equipment, sonobuoys, and underwater weapons such as torpedos or mine countermeasures.

Figure 8:
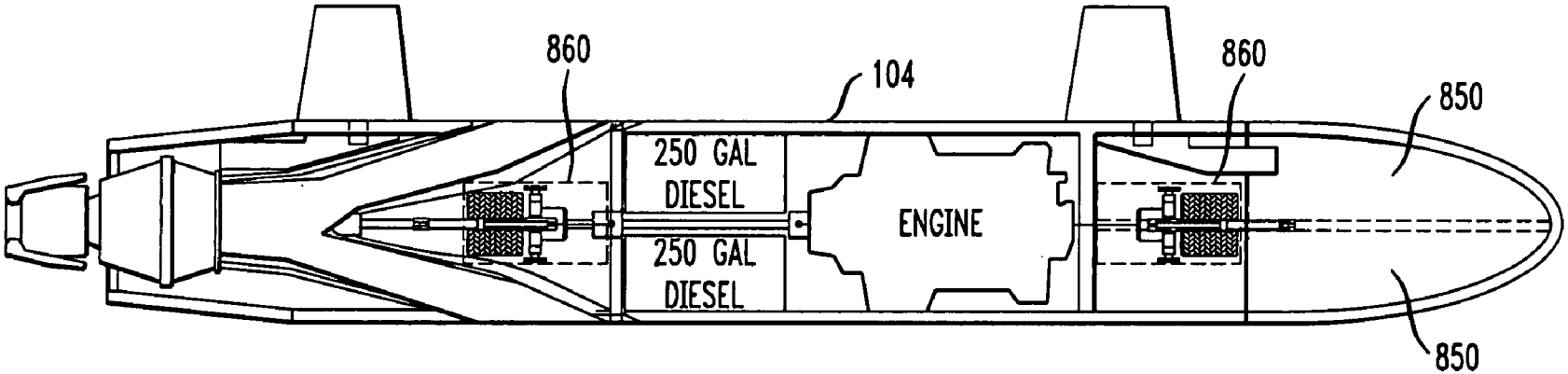
FIG. 8 depicts a top, sectional view of a lower hull of the marine vessel of FIG. 2A. This Figure shows two mission bays, which are disposed near the bow of the lower hull of the marine vessel.
Figure 9:
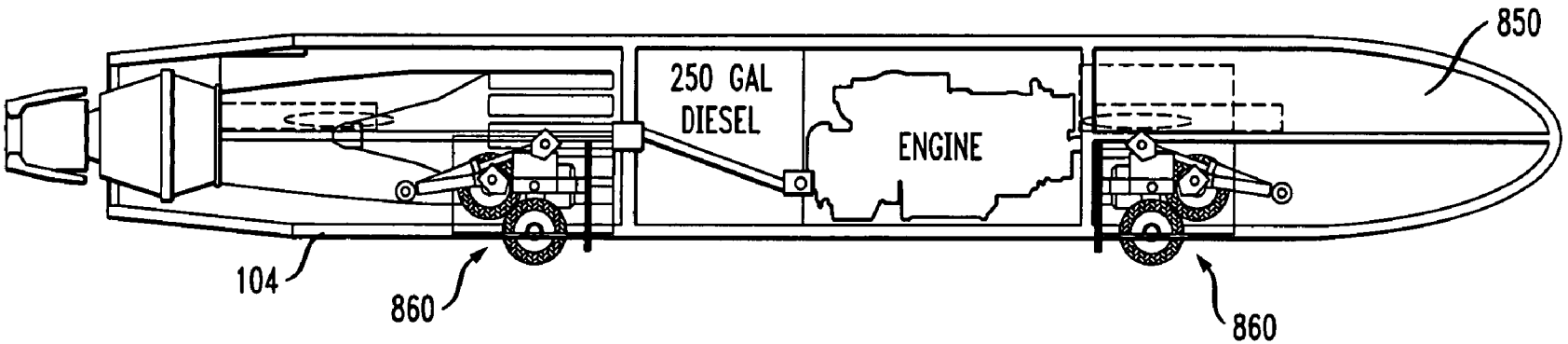
FIG. 9 depicts a side, sectional view of the lower hull of FIG. 8.

As depicted in FIG. 8, which shows a top, sectional view of one of lower hulls 104, one mission module 850 is disposed on each side of (each) lower hull 104. In the illustrative embodiment of marine vessel, mission module 850 is disposed in the upper half of the bow end of lower hulls 104, as depicted in FIG. 9.

Figure 11:
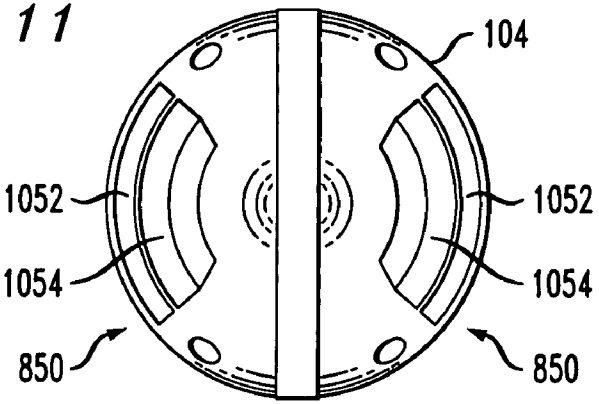
FIG. 11 depicts a bow-view of the lower hull of FIG. 10.
Figure 10:
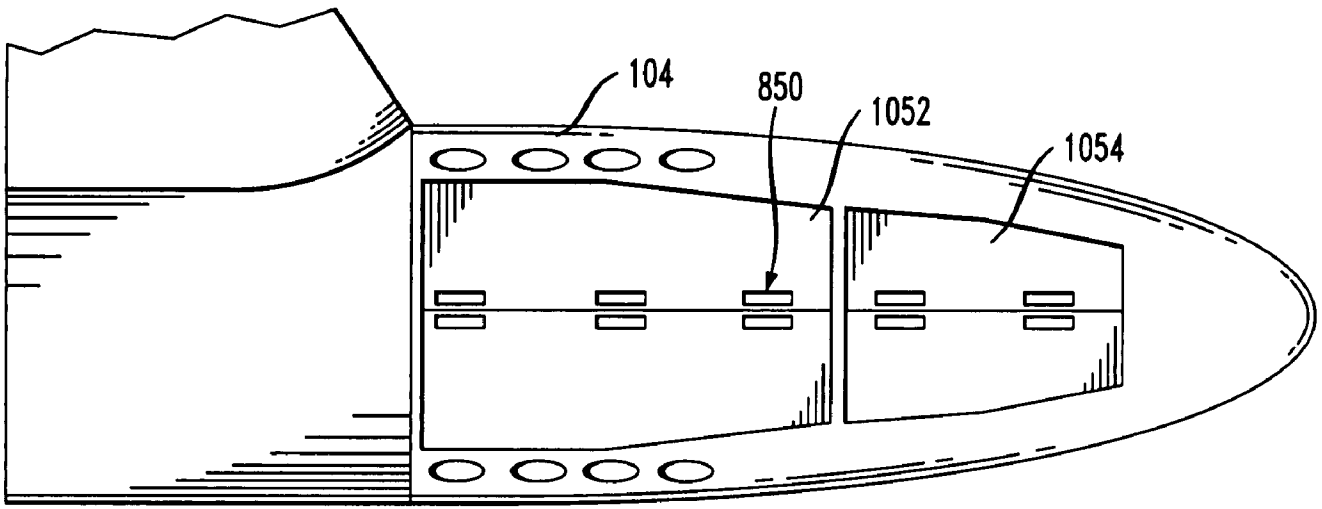
FIG. 10 depicts a side view of a lower hull of the marine vessel of FIG. 2A.

As depicted in FIG. 10 (side view) and FIG. 11 (bow-end view), mission modules 850 are accessed through ports 1052 and 1054 in lower hulls 104 In some embodiments, these ports automatically rotate open to expose mission modules 850.

As indicated above, it is anticipated that one tactical package for the lower mission bay is a torpedo. Since space is limited, the torpedo tube that contains the torpedo will not be substantially longer than the torpedo. Without some accommodation, if the torpedo is fired, marine vessel 100 will be light and tend to rise.

To address this problem, void regions that surround the torpedo tube are arranged to rapidly fill with water when a torpedo is fired. The total volume of water that is held by these voids regions and the torpedo tube (after the torpedo fires), equals the weight of the torpedo.

Wheel Assemblies

Referring again to FIGS. 8 and 9, to enable vessel 100 to move about the operations deck of its mother ship without additional handling equipment, each lower hull 102 houses two wheel assemblies 860. One wheel assembly 860 is disposed underneath mission bays 850 and the other is located aft on the other side of the engine and fuel tanks.

When vessel 100 is in its launch/recovery configuration, wheel assemblies 860 deploy. When struts 106 are unfolded for operation (e.g., cruise-and-surveillance configuration, minimum-draft configuration, etc.), wheel assemblies 860 retract into lower hulls 104. The wheels are driven, such that vessel 100 can move under its own power. Marine vessel 100 can be controlled (e.g., steered) by coupling a joy stick to interface electronics (i.e., wheel control electronics) located underneath a panel in one of lower hulls 104.

Figure 12:
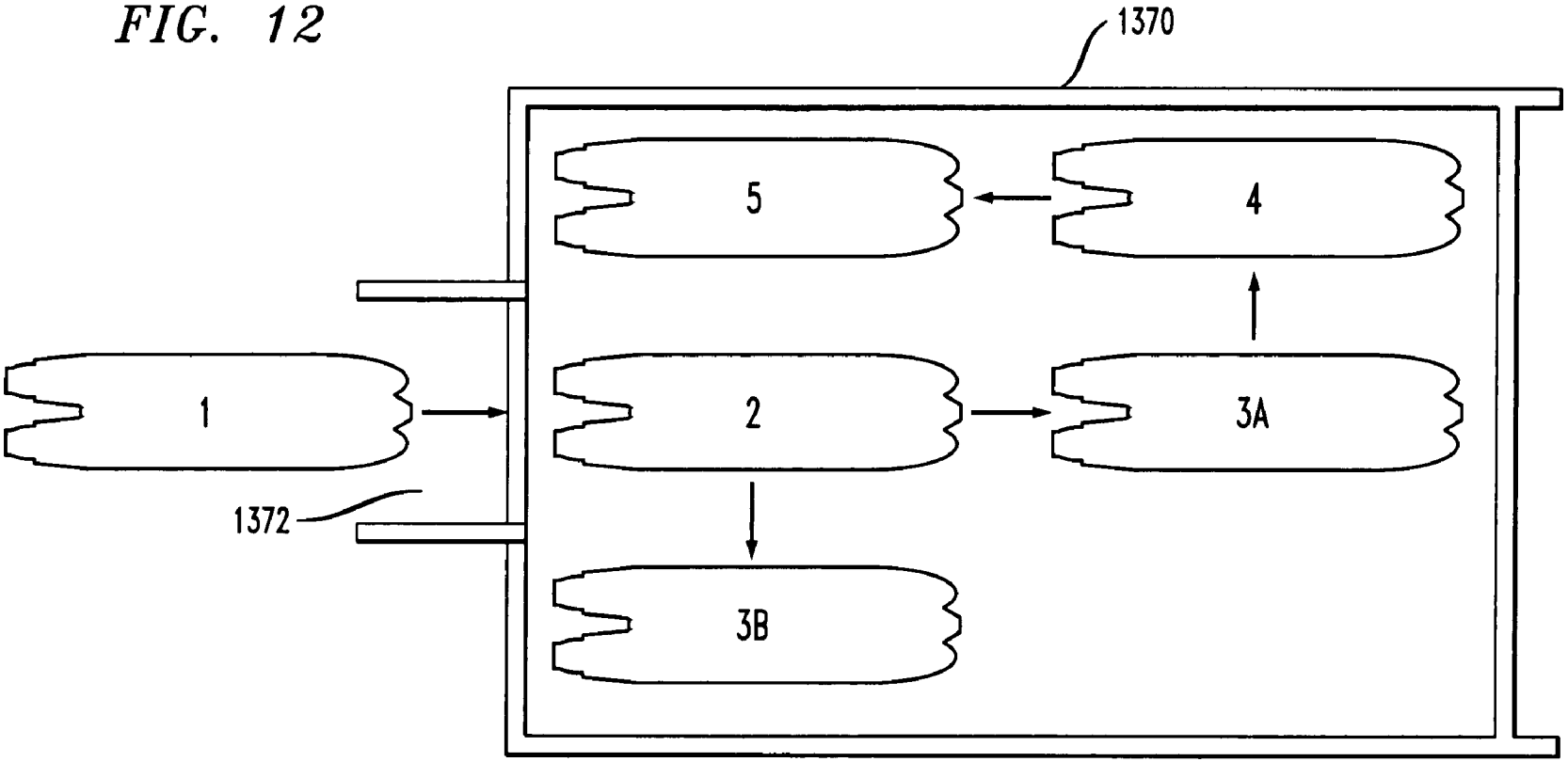
FIG. 12 depicts the movement of marine vessel 100 within a recovery area aboard a mother ship.

Once on board the mother ship, it is normally necessary to move small vessels laterally to clear the recovery area. But there is often little room to maneuver. In accordance with the illustrative embodiment, the wheels of marine vessel 100 are capable of rotating 90 degrees so that the vessel can move laterally rather than having to "turn." FIG. 12 depicts recovery area 1370 of a mother ship and depicts marine vessel 100 moving laterally in accordance with the illustrative embodiment of the invention.

Marine vessel 100 moves from position 1 atop launch/recovery ramp 1372 to position 2 in recovery area 1370. Vessel 100 must be moved away from position 2 to permit other vessels to enter or leave recovery 1372. As a consequence, vessel 100 is moved directly ahead to position 3A, laterally to 4, and then back to 5. Alternatively, vessel 100 is moved laterally to position 3B. In either case, the ability to move laterally greatly simplifies maneuvering in recovery area 1370.

FIGS. 13A-13C depict top views of one of wheel assemblies 860 and FIGS. 14A-14C depict corresponding side views of the one wheel assembly 860.

FIGS. 13A and 14A depict wheel assembly 860 retracted within lower hull 104. FIGS. 13B and 14B depict wheel assembly 860 deployed and aligned with the long axis of lower hull 104. When wheel assembly 860 is oriented as in FIGS. 13B and 14B, marine vessel 100 is capable of moving forward or backward (e.g., to position 3A from position 2 or to position 5 from position 4, as shown in FIG. 12.

FIGS. 13C and 14C depict wheel assembly 860 deployed and rotated 90 degrees relative to the long axis of lower hull 104. The orientation of wheel assembly 860 that is depicted in FIGS. 13C and 14C enable marine vessel 100 to move laterally, as to position 3B from position 2 or as to position 4 from position 3A.

In the illustrative embodiment, a simple piston (1462) and hinge (1464, 1466) arrangement is used to facilitate retraction and deployment of wheel assembly 860. Motor 1468 is used to rotate the wheels.

It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Furthermore, it is to be understood that the above-described embodiments are merely illustrative of the present invention and that many variations of the above-described embodiments can be devised by those skilled in the art without departing from the scope of the invention. It is therefore intended that such variations be included within the scope of the following claims and their equivalents.

I claim:

1. A marine vessel comprising:

an upper hull;

a mission module bay, wherein said mission module bay is defined as an opening in said upper hull in the form of a cut-out;

a first propulsion hull, wherein said first propulsion hull remains at least partially submerged when said marine vessel is in water;

a first reconfigurable, segmented strut, wherein said first strut couples said first propulsion hull and said upper hull to each other;

a removable mission module, wherein said mission module is disposed within said mission module bay, and wherein a top and two sides of said removable mission module are substantially continuous with a top and two sides of said upper hull when disposed in said mission module bay, thereby filling said cut-out portion of said upper hull;

a mission bay, wherein said mission bay is disposed in said first propulsion hull, and wherein said mission bay is a storage volume for containing deployable mission payloads selected from the group consisting of underwater sensors, portable equipment, and countermeasures; and a first wheel assembly and a second wheel assembly, wherein said first wheel assembly and second wheel assembly are:

(1) disposed in said first propulsion hull;

(2) operable to deploy from said first propulsion hull; and (3) operable to partially rotate about a vertical axis enabling lateral movement of said marine vessel with zero turning radius.

2. The marine vessel of claim 1 wherein said mission module contains mission-specific items, wherein said items are selected from the group consisting of special weapons, special sensors, expendables, and personnel.

3. The marine vessel of claim 1 wherein said mission module comprises electrical and data interfaces that couple to electrical and data interfaces in said upper hull.

4. The marine vessel of claim 1 wherein said mission module comprises:

a first hatch for providing access to an interior of said mission module; and a second hatch for deploying weapons from said interior of said mission module.

5. The marine vessel of claim 1 wherein said mission bay is disposed in a bow of said propulsion hull.

6. The marine vessel of claim 1 wherein said first reconfigurable, segmented strut is movable to change the position of said first propulsion hull relative to said upper hull.

7. The marine vessel of claim 1 further comprising:

a second propulsion hull; and a second reconfigurable, segmented strut, wherein said second strut couples said second propulsion hull and said upper hull to each other, wherein said second strut is movable to change the position of said second propulsion hull relative to said upper hull.

8. A marine vessel comprising:

an upper hull;

a mission module bay, wherein said mission module bay is defined as an opening in said upper hull;

two lower hulls, wherein said two lower hulls are coupled to said upper hull;

a first removable mission module, wherein said mission module is disposed within said mission module bay and removable therefrom to be replaced by a second removable mission module, and wherein said first removable mission module and said second removable mission module contain different mission-specific items; and wheel assemblies, wherein at least two wheel assemblies are disposed in each of said lower hulls, and wherein each of said wheel assemblies are operable to deploy from said lower hulls, and further wherein when deployed, said wheel assemblies are operable to partially rotate about a vertical axis enabling lateral movement of said marine vessel with zero turning radius.

9. The marine vessel of claim 8 further comprising an arrangement for changing a spatial relationship of said two lower hulls to said upper hull, thereby reconfiguring said marine vessel, wherein said arrangement comprises:

two articulated struts, wherein each of said articulated struts movably couples one of said two lower hulls to said upper hull; and a motor for moving each of said articulated struts.

* * * * *